US009283572B2

(12) United States Patent
Derrick et al.

(10) Patent No.: US 9,283,572 B2
(45) Date of Patent: Mar. 15, 2016

(54) CENTRIFUGE WITH AUTOMATIC SAMPLING AND CONTROL AND METHOD THEREOF

(71) Applicant: Derrick Corporation, Buffalo, NY (US)

(72) Inventors: Bradley T. Derrick, Orchard Park, NY (US); Michael J. Schwec, Hamburg, NY (US)

(73) Assignee: Derrick Corporation, Buffalo, NY (US)

( * ) Notice: Subject to any disclaimer, the term of this patent is extended or adjusted under 35 U.S.C. 154(b) by 0 days.

(21) Appl. No.: 14/480,296

(22) Filed: Sep. 8, 2014

(65) Prior Publication Data

US 2015/0072850 A1 Mar. 12, 2015

Related U.S. Application Data

(60) Provisional application No. 61/875,517, filed on Sep. 9, 2013.

(51) Int. Cl.
*B04B 1/20* (2006.01)
*B04B 13/00* (2006.01)

(52) U.S. Cl.
CPC ..... *B04B 1/2016* (2013.01); *B04B 1/20* (2013.01); *B04B 13/00* (2013.01)

(58) Field of Classification Search
CPC ..... B04B 9/10; B04B 13/00; B04B 1/20; B01F 1/2016
USPC ..... 494/1, 5, 7–10, 12, 42, 52–54, 84, 37; 210/380.3; 700/273
See application file for complete search history.

(56) References Cited

U.S. PATENT DOCUMENTS

| | | | | | |
|---|---|---|---|---|---|
| 5,203,762 | A | * | 4/1993 | Cooperstein | 494/7 |
| 5,681,256 | A | * | 10/1997 | Nagafuji | 494/9 |
| 5,857,955 | A | * | 1/1999 | Phillips et al. | 494/5 |
| 5,919,123 | A | * | 7/1999 | Phillips | 494/7 |
| 5,948,271 | A | * | 9/1999 | Wardwell et al. | 210/739 |
| 6,073,709 | A | | 6/2000 | Hensley | |
| 6,143,183 | A | * | 11/2000 | Wardwell et al. | 210/739 |
| 6,368,264 | B1 | * | 4/2002 | Phillips et al. | 494/5 |
| 6,600,278 | B1 | * | 7/2003 | Bretzius | 318/34 |
| 6,823,238 | B1 | | 11/2004 | Hensley et al. | |
| 6,860,845 | B1 | * | 3/2005 | Miller et al. | 494/1 |
| 6,905,452 | B1 | * | 6/2005 | Kirsch | 494/8 |
| 6,971,982 | B1 | * | 12/2005 | Kirsch | 494/8 |

(Continued)

FOREIGN PATENT DOCUMENTS

| | | | |
|---|---|---|---|
| WO | WO 2013183287 A1 | * | 12/2013 |
| WO | 2015154181 | * | 10/2015 |

*Primary Examiner* — Charles Cooley
(74) *Attorney, Agent, or Firm* — Simpson & Simpson, PLLC

(57) ABSTRACT

A centrifuge including a bowl, a bowl drive motor, a screw conveyor, a screw conveyor drive motor, a pump, a pump motor, a bowl VFD to drive the bowl drive motor, a conveyor VFD to drive the screw conveyor drive motor, a pump VFD to drive the pump drive motor, an analysis assembly and a computer electrically connected to the bowl VFD, the conveyor VFD, the pump VFD, and the analysis assembly. The analysis assembly is configured to automatically sample slurry pumped into the bowl and automatically transmit data, characterizing the slurry, to the computer. The computer is configured to calculate control schemes for the bowl VFD, the conveyor VFD, and the pump VFD using the data and, transmit control signals to the bowl VFD, the conveyor VFD and the pump VFD to operate the bowl VFD, the conveyor VFD and the pump VFD according to the control schemes.

24 Claims, 2 Drawing Sheets

(56) References Cited

U.S. PATENT DOCUMENTS

| | | | | |
|---|---|---|---|---|
| 6,981,940 | B2 * | 1/2006 | Rafferty | 494/7 |
| 7,135,107 | B2 | 11/2006 | Palmer | |
| 7,387,602 | B1 * | 6/2008 | Kirsch | 494/8 |
| 7,431,846 | B2 | 10/2008 | Palmer | |
| 7,540,837 | B2 * | 6/2009 | Scott et al. | 494/7 |
| 7,540,838 | B2 * | 6/2009 | Scott et al. | 494/7 |
| 8,172,740 | B2 * | 5/2012 | El Dorry et al. | 494/8 |
| 9,206,064 | B2 * | 12/2015 | Hiramatsu | F23G 7/001 |
| 2004/0259710 | A1 * | 12/2004 | Rafferty | 494/15 |
| 2005/0218077 | A1 | 10/2005 | Brunsell | |
| 2005/0279154 | A1 * | 12/2005 | Fout et al. | B04B 1/2016 |
| 2006/0105896 | A1 * | 5/2006 | Smith et al. | 494/7 |
| 2007/0087927 | A1 * | 4/2007 | Scott et al. | 494/7 |
| 2009/0105059 | A1 * | 4/2009 | Dorry et al. | 494/37 |
| 2012/0245014 | A1 | 9/2012 | Jones et al. | |
| 2013/0043195 | A1 | 2/2013 | O'Konek et al. | |
| 2013/0200007 | A1 | 8/2013 | O'Konek et al. | |
| 2015/0072850 | A1 * | 3/2015 | Derrick et al. | 494/8 |

* cited by examiner

CENTRIFUGE WITH AUTOMATIC SAMPLING AND CONTROL AND METHOD THEREOF

CROSS-REFERENCE TO RELATED APPLICATIONS

This application claims the benefit under 35 U.S.C. §119 (e) of U.S. Provisional Patent Application No. 61/875,517, filed Sep. 9, 2013, which application is incorporated herein by reference in its entirety.

FIELD OF THE INVENTION

The present disclosure relates to a centrifuge with automatic sampling and analysis of a slurry pumped to the centrifuge and a liquid effluent discharged from the centrifuge, and automatic control of bowl, conveyor and pump motors.

BACKGROUND OF THE INVENTION

It is known to measure properties of a feed slurry and a liquid effluent stream for a centrifuge by analyzing samples taken by hand by an operator of the centrifuge. The analysis is then used to determine control parameters for operation of a centrifuge. For example, the operator obtains and analyzes the data to determine set points for the various motors in the centrifuge and then manually enters the set points into a control system for the centrifuge.

The known method of manual sampling and control input is not responsive to current conditions in the centrifuge, since there is a time delay between obtaining samples and manually inputting set points due to the necessity for the operator to analyze the samples and determine proper control set points. Further, to most accurately control the centrifuge to respond to real time conditions, given the above drawbacks, would require almost continuous manual sampling by the operator. That is, the operator would be virtually dedicated to the sampling, analysis, and set point calculation noted above, which would greatly increase operating costs, since further personnel may be necessary to address operational needs that the operator cannot attend to. Also, manually obtaining samples requires the operator to be in the immediate proximity of the centrifuge. Given the size, mass, and speeds associated with operation of the centrifuge and to prevent injury to the operator, it is desirable to limit the amount of time an operator must spend in the immediate vicinity of the centrifuge.

SUMMARY OF THE INVENTION

According to aspects illustrated herein, there is provided a centrifuge for centrifuging a slurry, including: a bowl driven by a bowl drive motor; a screw conveyor driven by a screw conveyor drive motor; a pump driven by a pump motor; a bowl variable frequency drive unit (VFD) operatively arranged to drive the bowl drive motor; a conveyor VFD operatively arranged to drive the screw conveyor drive motor; a pump VFD operatively arranged to drive the pump drive motor; a first analysis assembly connected to a first section of pipe connecting the pump and the bowl; and at least one computer electrically connected to the bowl VFD, the conveyor VFD, the pump VFD, and the first analysis assembly. The first analysis assembly is configured to automatically sample a slurry pumped through the first section of pipe and automatically transmit first data, characterizing the slurry, to the at least one computer. The at least one computer is configured to calculate respective control schemes for the bowl VFD, the conveyor VFD and the pump VFD using the first data and transmit respective control signals to the bowl VFD, the conveyor VFD and the pump VFD to operate the bowl VFD, the conveyor VFD and the pump VFD according to the respective control schemes.

According to aspects illustrated herein, there is provided a centrifuge for centrifuging a slurry, including: a bowl driven by a bowl drive motor; a screw conveyor driven by a screw conveyor drive motor; a pump driven by a pump motor; a bowl variable frequency drive unit (VFD) operatively arranged to drive the bowl drive motor; a conveyor VFD operatively arranged to drive the screw conveyor drive motor; a pump VFD operatively arranged to drive the pump drive motor; a first analysis assembly; and at least one computer electrically connected to the bowl VFD, the conveyor VFD, the pump VFD, and the first analysis assembly. The first analysis assembly is configured to automatically sample a liquid effluent discharged from the centrifuge and automatically transmit first data, characterizing the liquid effluent, to the at least one computer. The at least one computer is configured to calculate respective control schemes for the bowl VFD, the conveyor VFD and the pump VFD using the first data and transmit respective control signals to the bowl VFD, the conveyor VFD and the pump VFD to operate the bowl VFD, the conveyor VFD and the pump VFD according to the respective control schemes.

According to aspects illustrated herein, there is provided a centrifuge for centrifuging a slurry, including: a bowl driven by a bowl drive motor; a screw conveyor driven by a screw conveyor drive motor; a pump driven by a pump motor; a bowl variable frequency drive unit (VFD) operatively arranged to drive the bowl drive motor; a conveyor VFD operatively arranged to drive the screw conveyor drive motor; a pump VFD operatively arranged to drive the pump drive motor; a first analysis assembly connected to a section of pipe connecting the pump and the bowl; a second analysis assembly; and at least one computer electrically connected to the bowl VFD, the conveyor VFD, the pump VFD, and the first and second analysis assemblies. The first analysis assembly is configured to automatically sample a slurry pumped through the first section of pipe and automatically transmit first data, characterizing the slurry, to the at least one computer. The second analysis assembly is configured to automatically sample a liquid effluent discharged from the centrifuge and automatically transmit first data, characterizing the liquid effluent, to the at least one computer. The at least one computer is configured to calculate respective control schemes for the bowl VFD, the conveyor VFD and the pump VFD using the first and second data and transmit respective control signals to the bowl VFD, the conveyor VFD and the pump VFD to operate the bowl VFD, the conveyor VFD and the pump VFD according to the respective control schemes.

According to aspects illustrated herein, there is provided a method for centrifuging a slurry using a centrifuge including a bowl driven by a bowl drive motor, a screw conveyor driven by a screw conveyor drive motor, a pump driven by a pump motor, a bowl variable frequency drive unit (VFD) operatively arranged to drive the bowl drive motor, a conveyor VFD operatively arranged to drive the screw conveyor drive motor, a pump VFD operatively arranged to drive the pump drive motor, a first analysis assembly connected to a first section of pipe connecting the pump and the bowl, a second analysis assembly, and at least one computer electrically connected to the bowl VFD, the conveyor VFD, the pump VFD, and the first and second analysis assemblies, the method including: automatically sampling, using the first analysis assembly, a slurry pumped through the first section of pipe; automatically transmitting, using the first analysis assembly, first data, characterizing the slurry, to the at least one computer; automatically sampling, using the second analysis assembly, a liquid effluent discharged from the centrifuge; automatically transmitting, using the second analysis assembly, second data, characterizing the liquid effluent, to the at least one computer; calculating, using the at least one computer, respective control schemes for the bowl VFD, the conveyor VFD and the pump VFD using the first and second data; transmitting, using the at least one computer, respective control signals to the bowl VFD, the conveyor VFD and the pump VFD; and operating the bowl VFD, the conveyor VFD and the pump VFD according to the respective control schemes.

BRIEF DESCRIPTION OF THE DRAWINGS

Various embodiments are disclosed, by way of example only, with reference to the accompanying schematic drawings in which corresponding reference symbols indicate corresponding parts, in which.

DESCRIPTION OF THE PREFERRED EMBODIMENT

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
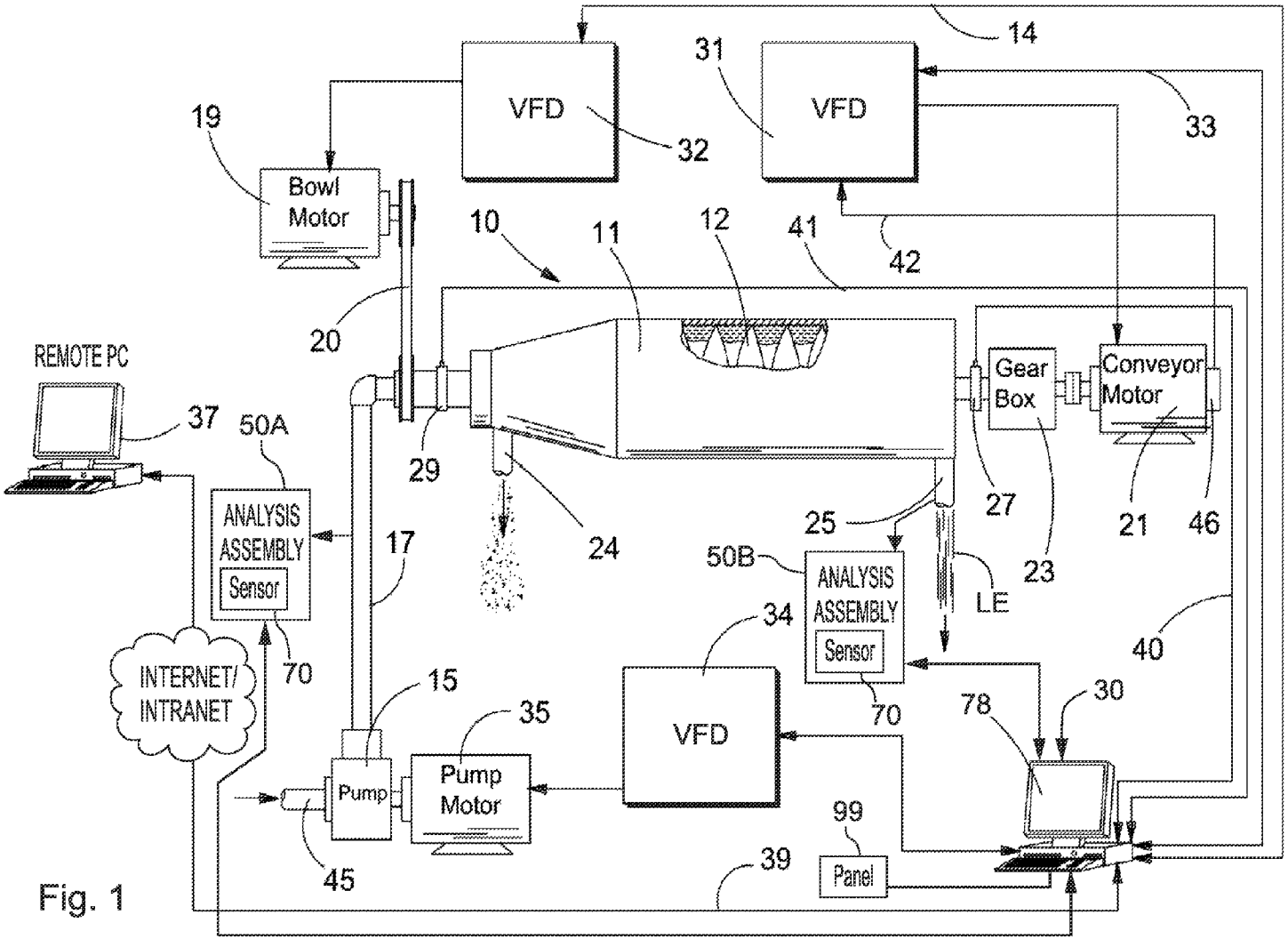
FIG. 1 is a schematic representation of a centrifuge with automatic sampling and control; and, FIG. 2 is a schematic block diagram of the centrifuge of FIG. 1.

FIG. 1 is a schematic representation of centrifuge 10 with automatic sampling and control. Centrifuge 10, for example a decanter style centrifuge, includes bowl 11, screw conveyor 12, pump 15, bowl drive motor 19, conveyor drive motor 21, and pump motor 35. Centrifuge 10 includes: bowl variable frequency drive unit (VFD) 32 operatively arranged to drive the bowl drive motor; conveyor VFD 31 operatively arranged to drive the screw conveyor drive motor; pump VFD 34 operatively arranged to drive the pump drive motor; and at least one computer 30 (hereinafter referred to as "computer 30") electrically connected to the bowl VFD, the conveyor VFD, and the pump VFD. In an example embodiment, centrifuge 10 includes analysis assembly 50A connected to pipe, or conduit, 17 connecting pump 15 and bowl 11. Assembly 50A is electrically connected to computer 30.

Figure 2:
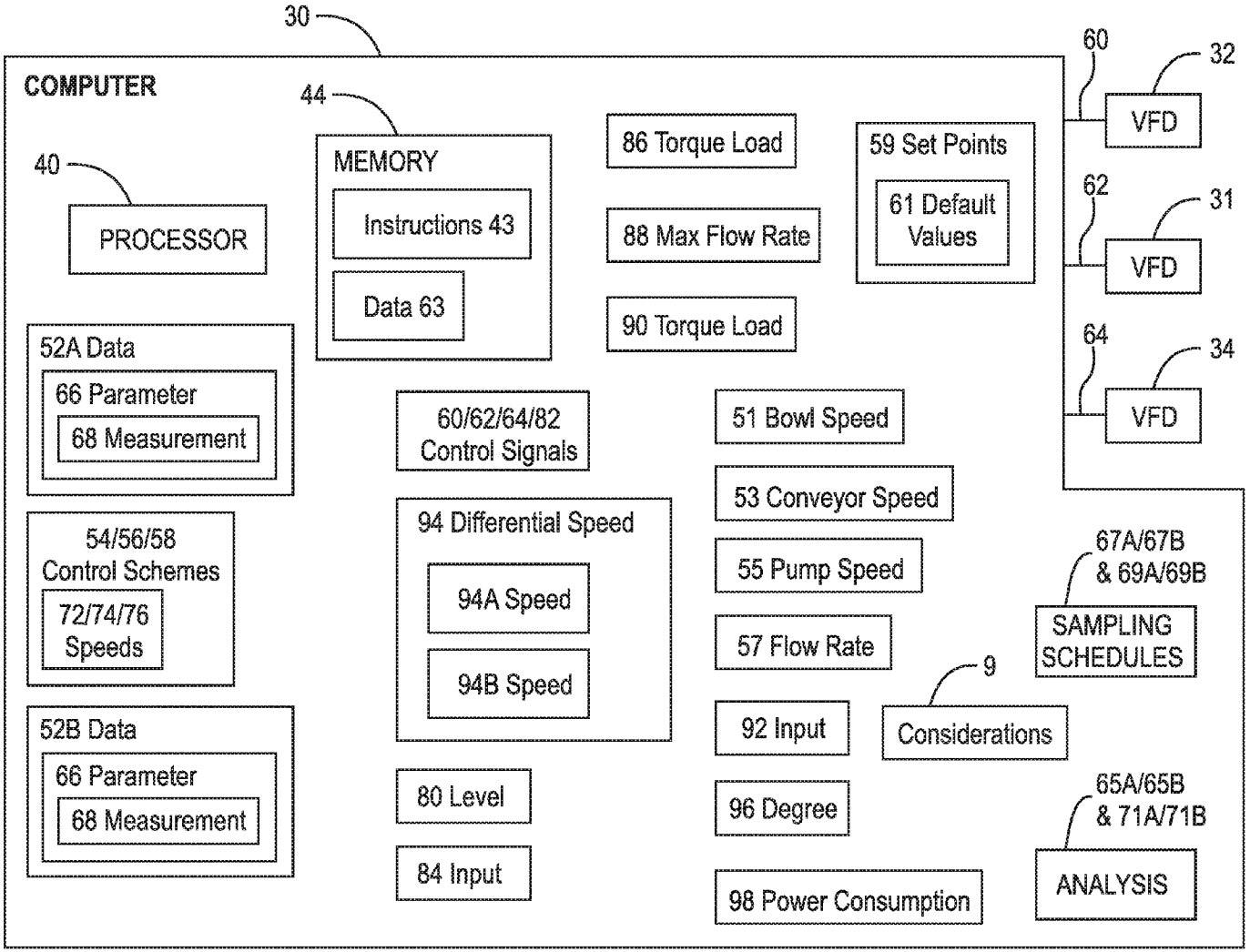

FIG. 2 is a schematic block diagram of centrifuge 10 of FIG. 1. In an example embodiment, computer 30 implements the functions and operations described above and below by using processor 40 to execute computer readable instructions 43 stored in memory element 44. Computer 30, processor 40 and memory element 44 can be any computer, processor, and memory element, respectively, known in the art.

Analysis assembly 50A is configured to automatically sample a slurry pumped through pipe 17 to the bowl and automatically transmit data 52A, characterizing the slurry, to computer 30. Computer 30 is configured to: calculate control schemes 54, 56, and 58 for the bowl VFD, the conveyor VFD and the pump VFD, respectively, using data 52A; and transmit control signals 60, 62, and 64 to the bowl VFD, the conveyor VFD and the pump VFD, respectively, to operate the bowl VFD, the conveyor VFD and the pump VFD according to control schemes 54, 56, and 58, respectively.

In an example embodiment, assembly 50A is configured to measure at least one parameter 66 of the slurry selected from the group consisting of feed density, viscosity, turbidity, solids content, particle distribution and flow rate, and transmit data 52A including measurement 68 of the at least one parameter 66. For example, assembly 50A includes any sensors or other apparatus 70 known in the art for sampling the slurry and measuring one, some, or all of parameters 66. It should be understood that assembly 50A is not limited to measuring the parameters noted above and that assembly 50A can measure any parameter known in the art using any sensors or apparatus known in the art.

In an example embodiment, as part of calculating control schemes 54, 56, and 58, computer 30 is configured to calculate speeds 72, 74, and 76 for the bowl drive motor, the screw conveyor drive motor and the pump motor, respectively, and transmit control signals 60, 62, and 64 including transmitting speeds 72, 74, and 76. In an example embodiment, computer 30 also calculates differential speed 94 between speeds 72 and 74.

Computer 30 and assembly 50A are configured to sample the slurry without intervention by an operator and to automatically transmit data 52A without intervention by an operator. That is, computer 30 and assembly 50A execute the operations necessary for sampling the slurry and transmitting data 52A independent of actions by an operator and without the necessity of intervention by the operator. Further, computer 30 generates and transmits control schemes 54, 56, and 58 without intervention by the operator, and VFDs 32, 31, and 34 control bowl drive motor 19, conveyor drive motor 21, and pump motor 35, respectively, without intervention by the operator. It should be understood that intervention by the operator is possible if desired.

In an example embodiment, computer 30 includes display device 78 and is configured to analyze data 52A to determine recommended level 80 for liquid in the bowl (pond level) and transmit signal 82, for display on display device 78, including recommended level 80.

In an example embodiment, computer 30 is configured receive input 84 identifying speeds 51 and 53 for the bowl and conveyor motors, respectively, desired torque load 86 for the conveyor motor, and maximum flow rate 88 for the pump. Computer 30 is configured to regulate pump speed 55/slurry flow rate 57 to maintain actual torque load 90 for the conveyor motor at desired torque load 86; or when unable to maintain actual torque load 90 for the conveyor motor at desired torque load 86, regulate pump speed 55/slurry flow rate 57 to maintain maximum flow rate 88. Input 84 can be generated by any means known in the art, for example, by an operator of centrifuge 10.

In an example embodiment, computer 30 is configured to: determine that actual torque load 90 is greater than desired torque load 86; and regulate pump speed 55 to control flow rate 57 of the slurry to reduce actual torque load 90 to be equal to or less than desired torque load 86. As is known in the art, the quickest means of reducing an undesirably high torque 90 is by increasing flow rate 57. However, as is also known in the art, the more effective, but slower, long term response to undesirably high torque 90 is manipulating differential speed 94 between the bowl and the conveyor as described below.

In an example embodiment, computer 30 is configured to: receive input 92 quantifying torque load 90 on the conveyor motor; vary differential speed 94 until, at differential speed 94A, torque load 90 increases by predetermined degree, or amount, 96; calculate differential speed 94B based on differential speed 94A, for example, slightly less than speed 94A to prevent a spike of torque 90; and, operate the bowl and conveyor motors to maintain differential speed 94B. In an example embodiment, computer 30 is configured to determine that torque load 90 is greater than desired torque level 86 and operate the bowl and conveyor motors to increase differential speed 94B to reduce torque load 90.

In an example embodiment, centrifuge 10 includes analysis assembly 50B configured to automatically sample liquid effluent LE discharged from the bowl through pipe, or conduit, 25 and automatically transmit data 52B, characterizing liquid effluent LE, to computer 30. Computer 30 is configured to calculate control schemes 54, 56, and 58 using data 52B.

In an example embodiment, assembly 50B is configured to measure at least one parameter 66 of effluent LE selected from the group consisting of feed density, viscosity, turbidity, solids content, particle distribution and flow rate, and transmit data 52B including measurement 68 of the at least one parameter 66. For example, assembly 50B includes any sensors or other apparatus 70 known in the art for sampling the slurry and measuring one, some, or all of parameters 66. It should be understood that assembly 50B is not limited to measuring the parameters noted above and that assembly 50B can measure any parameter known in the art using any sensors or apparatus known in the art.

In an example embodiment, centrifuge 10 includes assemblies 50A and 50B and computer 30 is configured to generate control schemes 54, 56, and 58 using data 52A and 52B.

In an example embodiment, conveyor drive motor 21 is coupled to conveyor 12 via gearbox 23. Centrifuge 10 receives the slurry via conduit, or pipe, 45 connected to pump 15. Pump 15 pumps the slurry to bowl 11 via conduit, or pipe 17. Bowl 11 is driven by bowl motor 19 via pulley arrangement 20, and screw conveyor 12 is driven by conveyor motor 21 via gear box 23. High density solids, which are separated from the slurry, are discharged from centrifuge 10 through conduit, or pipe, 24. The remaining portions of the slurry (liquid effluent LE) are ejected from the centrifuge via conduit 25. Bowl 11 is supported by two bearings 27 and 29. Conveyor motor speed and direction information are detected by encoder 46 and communicated to conveyor VFD 31 via line 42. Bowl VFD 32, conveyor VFD 31, and pump VFD 34 communicate with computer 30 over a communication network. Any VFD and any communication network known in the art can be used.

In an example embodiment, the operator can select modes of operation for centrifuge 10 including, but not limited to: barite recovery, cleanest effluent, driest solids, finest cut point, effluent percent solids, target effluent density, or any combination of these modes of operation, for example, listed by priority. Centrifuge 10 is capable of regulating bowl speed 51, conveyor speed 53, differential speed 94, and pump speed 55/slurry flow rate 57 automatically while indicating proper target pond depth, or level, setting 80 based upon a user selected operating mode for the apparatus. For example, computer 30 may calculate different respective values for speeds 72, 74, and 76 depending on the mode selected. Once in a selected operating mode, computer 30 generates control schemes 54, 56, and 58 and operates assemblies 50A and 50B as needed to most efficiently and effectively implement the operating mode selected by the operator.

In an example embodiment, various operation set points 59 are set to respective default values 61 for each operation mode. In an example embodiment, the operator may modify default values 61.

In an example embodiment, computer 30 has an economy mode in which computer 30 monitors power consumption 98 for the centrifuge and adjusts operating conditions for the centrifuge, for example, via control schemes 54, 56, and 58, to limit the power consumption. This is useful in cases where there is not adequate power available to operate centrifuge 10 at maximum capacity or in cases where power consumption is of concern.

An operator can interface directly with computer 30, via local operator control panel 99, or via remote computer 37 with a remote internet or intranet connection to computer 30. This enables an operator to monitor and control centrifuge 10 while on site or remotely from off site. Additional hardware allows for remote visual viewing of centrifuge 10 from offsite or onsite in cases where the apparatus may be difficult to access.

In an example embodiment remote computer 37 is linked to computer 30 by any means known in the art, including, but not limited to hardwire line 39 or wirelessly, so that troubleshooting or operation of centrifuge 10 can be monitored and controlled from a remote location, if desired.

In an example embodiment, computer 30 stores historical data 63 in memory element 44. Data 63 can include data 52A and 52B, control schemes 54, 56, and 58, speeds 72, 74, and 76, and any other information associated with operation of centrifuge 10. Data 63 can be used to record, identify, and track historical trends in the operation of centrifuge 10. Data 63 also can be used in the creation of control schemes 54, 56, and 58 and/or in control of assemblies 50A and 50B. For example control schemes 54, 56, and 58 generated using data 63 can account for operational considerations 9, derived from data 63 and not readily apparent from analysis of data 52A and 52B, and which impact optimal operation of centrifuge 10. Based on considerations 9, computer 30 can create control schemes 54, 56, and 58 to result in more efficient, effective, and/or safe operation of centrifuge 10 than would otherwise be possible. Based on considerations 9, computer 30 can control sampling frequency and the type of sampling and analysis performed by assemblies 50A and 50B to optimize functioning of centrifuge 10.

In an example embodiment, one or both of analysis assemblies 50A and 50B are configured to sample the slurry or liquid effluent LE, respectively, continuously. In an example embodiment, computer 30 is configured to analyze one or both of data 52A and 52B to generate one or both of analysis 65A and 65B, respectively, and to calculate one or both of sampling schedule 67A and or 67B, respectively, using one or both of analysis 65A and 65B, respectively. Computer 30 is then configured to switch one or both of assemblies 50A and 50B from sampling continuously to sampling according to schedule 67A or 67B, respectively. Note that one of assemblies 50A and 50B can be sampling according to a respective sampling schedule while the other analysis assembly is sampling continuously.

In an example embodiment, one or both of analysis assemblies 50A and 50B are configured to sample the slurry or liquid effluent LE, respectively, according to one or both of sampling schedule 69A and or 69B, respectively. In an example embodiment, computer 30 is configured to analyze one or both of data 52A and 52B to generate one or both of analysis 71A and 71B, respectively, and to switch one or both of assemblies 50A and 50B to continuous sampling based on one or both of analysis 71A and 71B, respectively. Schedules 69A and/or 69B can be calculated by computer 30 as noted above, or inputted to computer 30 by an operator. Note that one of assemblies 50A and 50B can be sampling according to a respective sampling schedule while the other analysis assembly is sampling continuously.

Thus, centrifuge 10, in particular assemblies 50A and 50B, utilizes various sampling and analysis hardware to measure parameters of the slurry and effluent LE, such as feed density, viscosity, turbidity, solids content, particle distribution and flow rate automatically and without operator intervention. Based on the measurements taken on the fly (either periodically or continuously) of the feed and effluent streams, computer 30 automatically determines the most effective and efficient mode of operation by varying bowl speed 51, conveyor speed 53, pump speed 55, differential speed 94, and pump flow rate 57 without operator input or intervention.

The following should be viewed in light of FIGS. 1 and 2. The following describes a method for centrifuging a slurry using a centrifuge. Although the method is presented as a sequence of steps for clarity, no order should be inferred from the sequence unless explicitly stated. The centrifuge includes bowl 11, screw conveyor 12, pump 15, bowl drive motor 19, conveyor drive motor 21, pump motor 35, bowl VFD 32, conveyor VFD 31, pump VFD 34, at least one computer 30 electrically connected to VFDs 32, 31 and 34, analysis assembly 50A connected to pipe 17 and electrically connected to computer 30, and analysis assembly 50B electrically connected to computer 30. A first step automatically samples, using analysis assembly 50A, a slurry pumped through pipe 17. A second step automatically transmits, using analysis assembly 50A, data 52A, characterizing the slurry, to computer 30. A third step automatically samples, using analysis assembly 50B, liquid effluent LE discharged from the centrifuge. A fourth step automatically transmits, using analysis assembly 50B, data 52B characterizing liquid effluent LE, to computer 30. A fifth step calculates, using the computer 30, control schemes 54, 56, and 58 for the bowl VFD, the conveyor VFD and the pump VFD, respectively, using data 52A and 52B. A sixth step transmits, using computer 30, control signals 60, 62, and 64, to the bowl VFD, the conveyor VFD and the pump VFD, respectively. A seventh step operates the bowl VFD, the conveyor VFD and the pump VFD according to control schemes 54, 56, and 58, respectively.

By way of introduction to the oil drilling application, barite, or heavy spar, is a sulfate of barium, $BaSO_4$, found in nature as tabular crystals or in granular or massive form and has a high specific gravity. Most crude barite requires some upgrading to minimum purity or density. Most barite is ground to a small, uniform size before it is used as a weighting agent in petroleum well drilling mud specification barite. Barite is relatively expensive, and an important objective of a preferred embodiment of the present invention is to recover barite from the slurry in an oil drilling operation for re-use.

It should be understood that centrifuge 10 and a method using centrifuge 10 is suitable for use in any situation or application requiring a centrifuge, for example, for handling material generated by earth drilling operations, for example, associated with oil and/or gas wells. With respect to oil and/or gas well drilling application, centrifuge 10 is arranged to centrifuge drilling mud and tailings.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A centrifuge for centrifuging a slurry, comprising:
- a bowl driven by a bowl drive motor;
- a screw conveyor driven by a screw conveyor drive motor;
- a pump driven by a pump motor;
- a bowl variable frequency drive unit (VFD) operatively arranged to drive the bowl drive motor;
- a conveyor VFD operatively arranged to drive the screw conveyor drive motor;
- a pump VFD operatively arranged to drive the pump drive motor;
- a first analysis assembly connected to a first section of pipe connecting the pump and the bowl; and,
- at least one computer electrically connected to the bowl VFD, the conveyor VFD, the pump VFD, and the first analysis assembly, wherein:
  - the first analysis assembly is configured to:
    - automatically sample a slurry pumped through the first section of pipe; and,
    - automatically transmit first data, characterizing the slurry, to the at least one computer; and,
  - the at least one computer is configured to:
    - calculate respective control schemes for the bowl VFD, the conveyor VFD and the pump VFD using the first data;
    - transmit respective control signals to the bowl VFD, the conveyor VFD and the pump VFD to operate the bowl VFD, the conveyor VFD and the pump VFD according to the respective control schemes;
    - receive a first input quantifying a torque load on the conveyor motor;
    - vary a first differential speed between the bowl and the conveyor until the torque load increases by a first degree at a second differential speed between the bowl and the conveyor;
    - calculate a third differential speed based on the second differential speed; and,
    - operate the bowl and conveyor motors to maintain the third differential speed.

2. The centrifuge of claim 1, wherein the first analysis assembly is configured to:
- measure at least one parameter of the slurry selected from the group consisting of feed density, viscosity, turbidity, solids content, particle distribution and flow rate; and,
- transmit the first data including a measurement of the at least one parameter.

3. The centrifuge of claim 1, wherein the at least one computer is configured to:
- calculate respective speeds for the bowl drive motor, the screw conveyor drive motor and the pump motor as part of the respective control schemes for the bowl VFD, the conveyor VFD and the pump VFD; and,
- transmit respective controls signals including the respective speeds as part of the respective control schemes for the bowl VFD, the conveyor VFD and the pump VFD.

4. The centrifuge of claim 1, wherein the first analysis assembly is configured to:
- sample the slurry without intervention by an operator of the centrifuge; and,
- transmit the first data without intervention by an operator of the centrifuge.

5. The centrifuge of claim 1, wherein the at least one computer:
includes a display device; and,
is configured to:
analyze the first data to determine a recommended level for liquid in the bowl; and,
transmit a signal, for display on the display device, including the recommended level.

6. The centrifuge of claim 1, wherein the at least one computer is configured to:
receive a first input identifying respective speeds for the bowl and conveyor, a desired torque load for the conveyor motor, and a maximum flow rate for the pump;
regulate pump speed to maintain an actual torque load for the conveyor motor at the desired torque load; or,
when unable to maintain an actual torque load for the conveyor motor at the desired torque load, regulate pump speed to maintain the maximum flow rate.

7. The centrifuge of claim 6, wherein the at least one computer is configured to:
determine that the actual torque load is greater than the desired torque load; and,
regulate the pump speed to control a flow rate of the slurry to reduce the actual torque load to be equal to or less than the desired torque load.

8. The centrifuge of claim 1, wherein the at least one computer is configured to:
determine that the torque load is greater than a desired torque level; and,
operate the bowl and conveyor motors to increase the third differential speed.

9. The centrifuge of claim 1, further comprising:
a second analysis assembly configured to:
automatically sample a liquid effluent discharged from the bowl; and,
automatically transmit second data, characterizing the liquid effluent, to the at least one computer, wherein:
the at least one computer is configured to calculate the respective control schemes for the bowl VFD, the conveyor VFD and the pump VFD using the first and second data.

10. A centrifuge for centrifuging a slurry, comprising:
a bowl driven by a bowl drive motor;
a screw conveyor driven by a screw conveyor drive motor;
a pump driven by a pump motor;
a bowl variable frequency drive unit (VFD) operatively arranged to drive the bowl drive motor;
a conveyor VFD operatively arranged to drive the screw conveyor drive motor;
a pump VFD operatively arranged to drive the pump drive motor;
a first analysis assembly; and,
at least one computer electrically connected to the bowl VFD, the conveyor VFD, the pump VFD, and the first analysis assembly, wherein:
the first analysis assembly is configured to:
automatically sample a liquid effluent discharged from the centrifuge; and,
automatically transmit first data, characterizing the liquid effluent, to the at least one computer; and,
the at least one computer is configured to:
calculate respective control schemes for the bowl VFD, the conveyor VFD and the pump VFD using the first data;
transmit respective control signals to the bowl VFD, the conveyor VFD and the pump VFD to operate the bowl VFD, the conveyor VFD and the pump VFD according to the respective control schemes;
receive a first input quantifying a torque load on the conveyor motor;
vary a first differential speed between the bowl and the conveyor until the torque load increases by a first degree at a second differential speed between the bowl and the conveyor;
calculate a third differential speed based on the second differential speed; and,
operate the bowl and conveyor motors to maintain the third differential speed.

11. The centrifuge of claim 10, wherein the first analysis assembly is configured to:
measure at least one parameter of the liquid effluent selected from the group consisting of feed density, viscosity, turbidity, solids content, particle distribution and flow rate; and,
transmit the first data including a measurement of the at least one parameter.

12. The centrifuge of claim 10, wherein the at least one computer is configured to:
calculate respective speeds for the bowl drive motor, the screw conveyor drive motor and the pump motor as part of the respective control schemes for the bowl VFD, the conveyor VFD and the pump VFD; and,
transmit respective controls signals including the respective speeds as part of the respective control schemes for the bowl VFD, the conveyor VFD and the pump VFD.

13. The centrifuge of claim 10, wherein the first analysis assembly is configured to:
sample the liquid effluent without intervention by an operator of the centrifuge; and,
transmit the first data without intervention by an operator of the centrifuge.

14. The centrifuge of claim 10, wherein the at least one computer:
includes a display device; and,
is configured to:
analyze the first data to determine a recommended level for liquid in the bowl; and,
transmit a signal, for display on the display device, including the recommended level.

15. The centrifuge of claim 10, wherein the at least one computer is configured to:
receive a first input identifying respective speeds for the bowl and conveyor, a desired torque load for the conveyor motor, and a maximum flow rate for the pump;
regulate pump speed to maintain an actual torque load for the conveyor motor at the desired torque load; or,
when unable to maintain an actual torque load for the conveyor motor at the desired torque load, regulate pump speed to maintain the maximum flow rate.

16. The centrifuge of claim 15, wherein the at least one computer is configured to:
determine that the actual torque load is greater than the desired torque load; and,
regulate the pump speed to control a flow rate of the slurry to reduce the actual torque load to be equal to or less than the desired torque load.

17. The centrifuge of claim 10, wherein the at least one computer is configured to:
determine that the torque load is greater than a desired torque level; and,
operate the bowl and conveyor motors to increase the third differential speed.

18. The centrifuge of claim 10, further comprising:

a second analysis assembly, connected to a first section of pipe connecting the pump and the bowl, configured to:

automatically sample a slurry pumped through the first section of pipe; and, automatically transmit second data, characterizing the slurry, to the at least one computer, wherein:

the at least one computer is configured to calculate the respective control schemes for the bowl VFD, the conveyor VFD and the pump VFD using the first and second data.

19. A centrifuge for centrifuging a slurry, comprising:

a bowl driven by a bowl drive motor;

a screw conveyor driven by a screw conveyor drive motor;

a pump driven by a pump motor;

a bowl variable frequency drive unit (VFD) operatively arranged to drive the bowl drive motor;

a conveyor VFD operatively arranged to drive the screw conveyor drive motor;

a pump VFD operatively arranged to drive the pump drive motor;

a first analysis assembly connected to a section of pipe connecting the pump and the bowl;

a second analysis assembly; and, at least one computer electrically connected to the bowl VFD, the conveyor VFD, the pump VFD, and the first and second analysis assemblies, wherein:

the first analysis assembly is configured to:

automatically sample a slurry pumped through the first section of pipe; and, automatically transmit first data, characterizing the slurry, to the at least one computer;

the second analysis assembly is configured to:

automatically sample a liquid effluent discharged from the centrifuge; and, automatically transmit first data, characterizing the liquid effluent, to the at least one computer; and, the at least one computer is configured to:

calculate respective control schemes for the bowl VFD, the conveyor VFD and the pump VFD using the first and second data; and, transmit respective control signals to the bowl VFD, the conveyor VFD and the pump VFD to operate the bowl VFD, the conveyor VFD and the pump VFD according to the respective control schemes;

receive a first input quantifying a torque load on the conveyor motor;

vary a first differential speed between the bowl and the conveyor until the torque load increases by a first degree at a second differential speed between the bowl and the conveyor;

calculate a third differential speed based on the second differential speed; and, operate the bowl and conveyor motors to maintain the third differential speed.

20. The centrifuge of claim 19, wherein the first or second analysis assembly is configured to sample the slurry or the liquid effluent, respectively, continuously.

21. The centrifuge of claim 20, wherein the at least one computer is configured to:

analyze the first or second data;

calculate a first sampling schedule or a second sampling schedule, respectively, using the analysis of the first or second data, respectively; and, operate the first or second analysis assembly to switch from continuously sampling the slurry to sampling the slurry according to the first or second sampling schedule, respectively.

22. The centrifuge of claim 19, wherein the first or second analysis assembly is configured to sample the slurry or the liquid effluent, respectively, according to a first or second sampling schedule, respectively.

23. The centrifuge of claim 22, wherein the at least one computer is configured to:

analyze the first or second data, respectively; and, according to the analysis of the first or second data, switch the first or second analysis assembly, respectively, from sampling the slurry or the liquid effluent according to the first or second sampling schedule, respectively, to continuously sampling the slurry or the liquid effluent, respectively.

24. A method for centrifuging a slurry using a centrifuge including a bowl driven by a bowl drive motor, a screw conveyor driven by a screw conveyor drive motor, a pump driven by a pump motor, a bowl variable frequency drive unit (VFD) operatively arranged to drive the bowl drive motor, a conveyor VFD operatively arranged to drive the screw conveyor drive motor, a pump VFD operatively arranged to drive the pump drive motor, a first analysis assembly connected to a first section of pipe connecting the pump and the bowl, a second analysis assembly, and at least one computer electrically connected to the bowl VFD, the conveyor VFD, the pump VFD, and the first and second analysis assemblies, the method comprising:

automatically sampling, using the first analysis assembly, a slurry pumped through the first section of pipe;

automatically transmitting, using the first analysis assembly, first data, characterizing the slurry, to the at least one computer;

automatically sampling, using the second analysis assembly, a liquid effluent discharged from the centrifuge;

automatically transmitting, using the second analysis assembly, second data, characterizing the liquid effluent, to the at least one computer;

calculating, using the at least one computer, respective control schemes for the bowl VFD, the conveyor VFD and the pump VFD using the first and second data;

transmitting, using the at least one computer, respective control signals to the bowl VFD, the conveyor VFD and the pump VFD;

operating the bowl VFD, the conveyor VFD and the pump VFD according to the respective control schemes;

receiving, using the at least one computer, a first input quantifying a torque load on the conveyor motor;

varying, using the at least one computer, a first differential speed between the bowl and the conveyor until the torque load increases by a first degree at a second differential speed between the bowl and the conveyor;

calculating, using the at least one computer, a third differential speed based on the second differential speed; and, operating, using the at least one computer, the bowl and conveyor motors to maintain the third differential speed.

* * * * *